US007318795B2

(12) United States Patent
Dauterive

(10) Patent No.: US 7,318,795 B2
(45) Date of Patent: Jan. 15, 2008

(54) TV CHAIR

(76) Inventor: Ross Dauterive, 1804 Mt. Carmel, Las Vegas, NV (US) 89123

( * ) Notice: Subject to any disclaimer, the term of this patent is extended or adjusted under 35 U.S.C. 154(b) by 49 days.

(21) Appl. No.: 11/170,512

(22) Filed: Jun. 29, 2005

(65) Prior Publication Data

US 2006/0003878 A1 Jan. 5, 2006

Related U.S. Application Data

(60) Provisional application No. 60/585,541, filed on Jul. 2, 2004.

(51) Int. Cl.
*A63B 71/00* (2006.01)

(52) U.S. Cl. ..... 482/148; 482/142; 280/647; 601/49

(58) Field of Classification Search ..... 482/140, 482/124; D6/334; 601/49; 280/647
See application file for complete search history.

(56) References Cited

U.S. PATENT DOCUMENTS 3,216,738 A * 11/1965 Bockus ..... 280/30
3,992,057 A * 11/1976 Studebaker ..... 297/467
4,796,881 A * 1/1989 Watterson ..... 482/73
4,815,732 A * 3/1989 Mahvi ..... 482/142
4,913,423 A * 4/1990 Farran et al. ..... 482/130
5,320,416 A * 6/1994 Kornberg ..... 297/467
5,451,092 A * 9/1995 Gray ..... 297/122
5,599,063 A * 2/1997 Lister et al. ..... 297/325
6,427,426 B1 * 8/2002 Dunton et al. ..... 54/1
6,601,922 B2 * 8/2003 Doolan et al. ..... 297/466
6,752,414 B1 * 6/2004 Waldron et al. ..... 280/649
2002/0115536 A1 * 8/2002 Hojo et al. ..... 482/51
2002/0198090 A1 * 12/2002 McKinney ..... 482/148
2003/0137167 A1 * 7/2003 Napell ..... 297/183.6
2003/0146601 A1 * 8/2003 Gutierrez ..... 280/650
2005/0067861 A1 * 3/2005 Avihod ..... 297/42
2005/0261114 A1 * 11/2005 Heitzman et al. ..... 482/142

* cited by examiner

*Primary Examiner*—Lori Amerson
(74) *Attorney, Agent, or Firm*—Tucker Ellis & West LLP

(57) ABSTRACT

An exercise apparatus for use by a crippled person for exercising their hips and legs. The apparatus comprising a base and a seat mounted on the base, the seat having two sides along the longitudinal axis of the seat. Cushions are located on the least two sides of the seat to spread the knees of a user of the exercise apparatus. A handrail mounted on the base over the anterior side of the seat.

8 Claims, 3 Drawing Sheets

TV CHAIR

CROSS-REFERENCE TO RELATED APPLICATIONS

This application claims the benefit of priority of U.S. Provisional Application No. 60/585,541 filed Jul. 2, 2004, hereby incorporated by reference.

BACKGROUND OF THE INVENTION

The present invention relates generally to exercise devices and more specifically to a method and apparatus for enabling a crippled person to exercise hips and legs to prevent hip location and muscle atrophy.

Crippled children, particularly those with cerebral palsy typically suffer trismatic spasms which eventually dislocate the greater trochanters from the hip sockets. Remedies for this problem include major surgery every two to three years. Thus, the need exists for a system and method that enable a crippled person to exercise their hips and legs that prevent hip dislocation and muscle atrophy.

BRIEF SUMMARY OF THE INVENTION

In accordance with an aspect of the present invention, there is provided herein an apparatus wherein a crippled person is securely and correctly positioned so that with little assistance they can exercise their hips and legs.

In accordance with an aspect, there is disclosed herein an exercise apparatus, comprising a base and a seat mounted on the base, the seat having two sides along the longitudinal axis of the seat. Cushions are located on the least two sides of the seat to spread the knees of a user of the exercise apparatus. A handrail mounted on the base over the anterior side of the seat.

In accordance with an aspect, there is described herein a method for exercising a crippled user. The method comprises positioning a seat such that user's knees are higher than the user's rump when the user is in a seated position, positioning a handrail over the anterior side of the seat, and spreading the user's knees a desired width.

Still other objects of the present invention will become readily apparent to those skilled in this art from the following description wherein there is shown and described a preferred embodiment of this invention, simply by way of illustration of one of the best modes best suited for to carry out the invention. As it will be realized, the invention is capable of other different embodiments and its several details are capable of modifications in various obvious aspects all without departing from the invention. Accordingly, the drawing and descriptions will be regarded as illustrative in nature and not as restrictive.

BRIEF DESCRIPTION OF THE SEVERAL VIEWS OF THE DRAWING

The accompanying drawings incorporated in and forming a part of the specification, illustrates several aspects of the present invention, and together with the description serve to explain the principles of the invention.

DETAILED DESCRIPTION OF INVENTION

Figure 1:
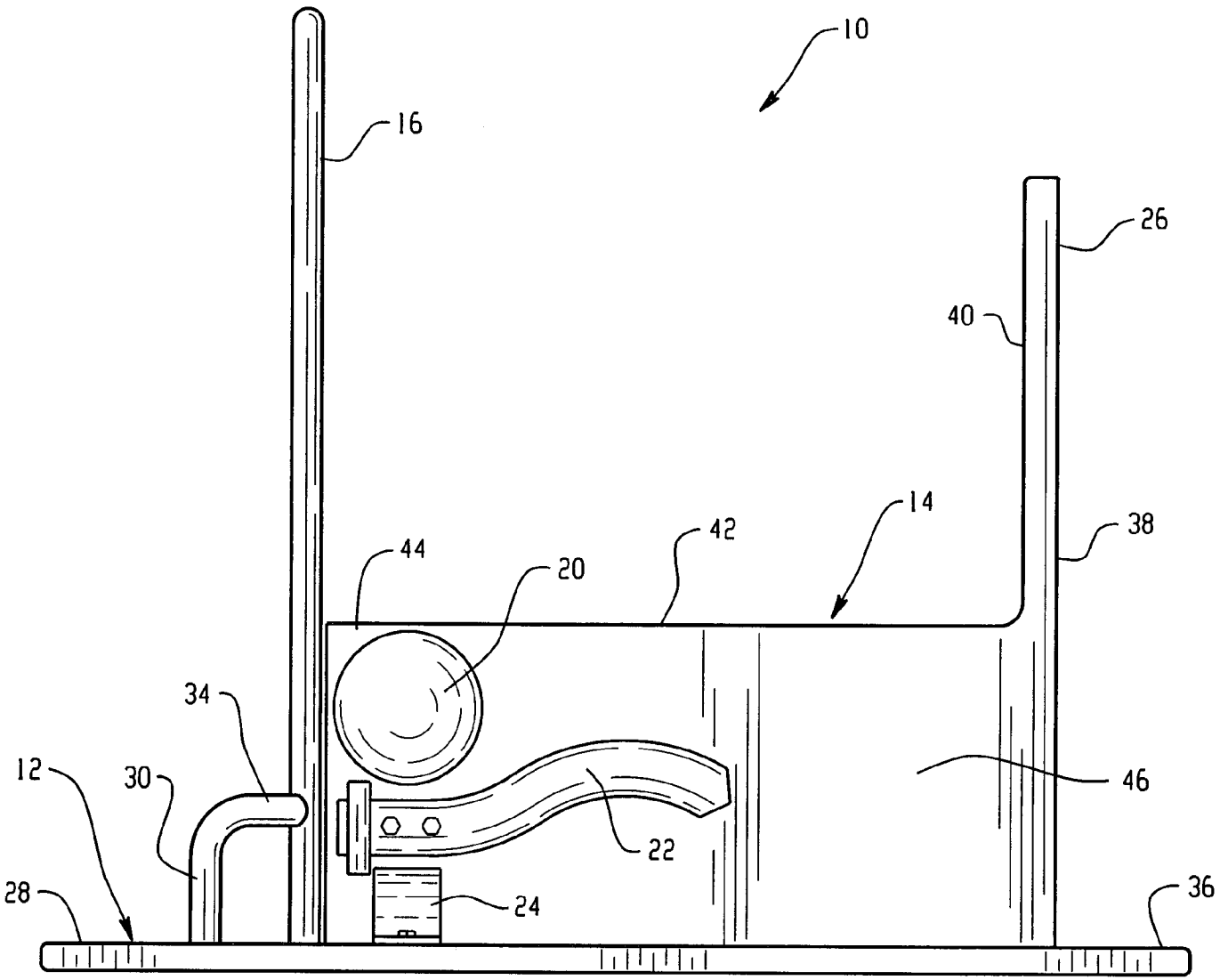
FIG. 1 is a side view of a TV Chair.
Figure 2:
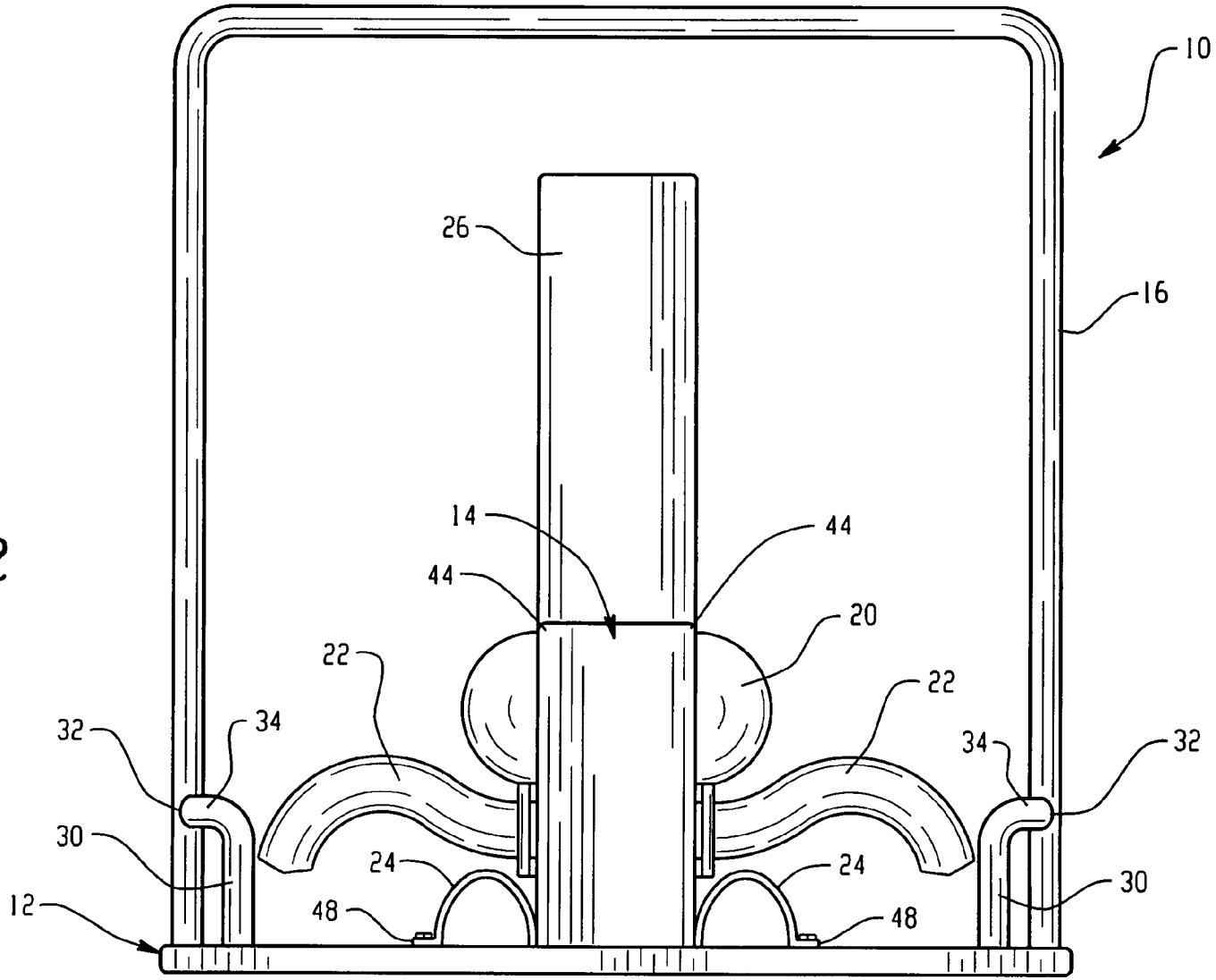
FIG. 2 is a rear view of a TV Chair.
Figure 3:
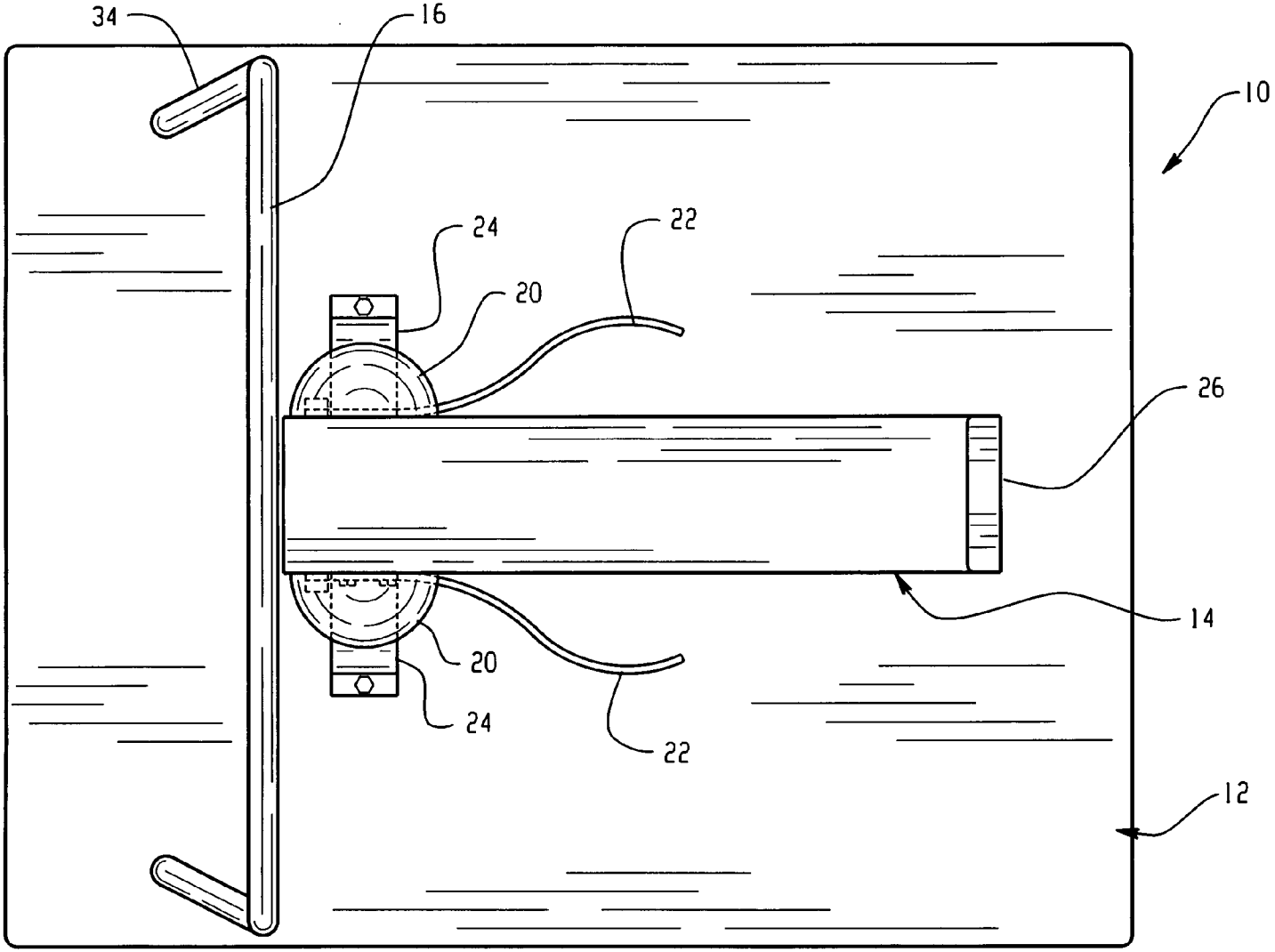
FIG. 3 is a top view of a TV Chair.

Throughout this description, the preferred embodiment and examples shown should be considered as exemplars, rather than limitations, of the present invention. Referring to the drawings, there is illustrated therein a TV Chair 10. The TV chair has a base 12. As illustrated, base 12 is rectangular in shape, however, base 12 can be elliptical, T-shaped, or any other suitable shape. Preferably the surface of base 12 is non-slip. In a preferred embodiment, the width of base 12 is three quarters the length of base 12.

TV chair 10 further comprises a squared u-shaped handrail 16. Handrail 16 is upstanding and crosses the width of base 12. Handrail 16 is mounted at the anterior end 28 of base 12, approximately one quarter of the length of bas 12 from anterior end 28. The height of handrail 16 is preferably three quarters the length of base 12, but can be adjusted to a sufficient height based on the height of the intended user of TV chair 10. Two upstanding sections 30 of handrail 16 rise from base 12 and form a T-intersection 32 on both sides of handrail 16. Upstanding sections 30 help stabilize handrail 16. As shown, T-intersections 32 are approximately one sixth the height of handrail 16. Preferably, the T-intersections 32 are formed of the same material as the handrail. For example, the handrail is suitably formed by using metal piping, or wood framing, or any material of sufficient strength to support the weight of the person using TV chair 10. In a preferred embodiment, upstanding sections 30 further comprise a horizontal section 34 that extend toward the anterior end 28 of base 12 at approximately a 45 degree angle toward the middle of handrail 16 and are parallel to base 12. When viewed from the length side of base 12, upstanding sections 30, horizontal section 34, handrail 16 and base 12 form a square with the surface of base 12 as the bottom of the square. The square formed by upstanding section 30, to horizontal section 34, handrail 16 and base 12 are referred to herein as the T-Leg. Padding (not shown) can be mounted on the top of handrail 16 to prevent injury to the user in case of a fall. Straps (not shown) can be mounted on top of handrail 16.

Terminating below handrail 16 and extending towards the posterior end 36 of base 12 is a seat 14, such as a bench type seat. As illustrated, seat 14 is a bench type seat with a length ⅝ the length of base 12 and runs midline along the length of base 12. The width of seat 14 is one eighth the length of base 12. At the rear 38 of seat 14 is a seat back or bench back 26. Preferably top 42 of seat 14 and the anterior surface 40 of back 26 are covered with a soft material and padding. Seat 14 is supported by a support structure 46. Support structure 46 is any suitably structure for supporting the weight of the person using the machine. Support structure 46 suitably comprises one or more legs and is of a material of sufficient strength.

Attached to the top anterior corners 44 of seat 14 are two semi-spherical cushions 20. As illustrated, the diameter of the cushions is half the length of seat 14. Cushion 20 is of sufficient size to spread apart the legs of the person using TV chair 10.

Directly below each cushion 20 is a Velcro strap 22. The slot buckle of strap 22 is secured below cushion 20. The strap is any suitable material of sufficient size to secure a person's ankles using TV chair 10. For example, the strap can be two inches wide and two feet in length.

Directly below each strap 22, secured to base 12 is a stirrup 24 for securing the foot of the user of TV chair 10. A typical stirrup 24 is made of a stiff, pliable material that is 3 inches wide and 10 inches long. One end 48 of the stirrup 24 is secured to base 12 and another end of stirrup 24 is secured to structure 46 of seat 14. In an exemplary embodiment, the ends are secured approximately 5 inches apart and forms an arch approximately 4 inches in height and 4½ inches wide on base 12.

In operation, a user (not shown) sits on seat 14 facing handrail 16. The users feet are secured in stirrups 24 and straps 22, for example Velcro straps, are wrapped around the user's ankles pulling the user's feet into stirrups 24 and securing them. The user's knees are spread apart and protected by cushions 20. The user graphs handrail 16 and pushes down with his feet and pulls up with his arms and stands. The user's knees are above seat 14, so that the user's rump rests below the knees when the user is seated in seat 14. An aspect of the present invention is that it provides the user with the opportunity to exercise his arms and legs and develop balance. The seat 14 and cushions 20 keep the user's knees separated and secured. The user's hips and legs are exercised in the same fashion as a shallow squat. However, TV chair 14 provides stability and keeps the user's knees separated allowing for secure exercise of the hips.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. For example, the exemplary measurements described herein may be modified according to the intended user. Accordingly, the present invention is intended to embrace all such alterations, modifications and variations that fall within the spirit and scope of the appended claims interpreted in accordance with the breadth to which they are fairly, legally and equitably entitled.

The invention claimed is:

1. An exercise apparatus, comprising:

a base;

a support structure mounted on the base a seat supported by the support structure, the seat having two sides along the longitudinal axis of the seat, wherein the seat is a bench seat;

a cushion located on the least two sides of the support structure below the seat and configured to splay knees of a user of the exercise apparatus, wherein the cushion is semi-spherical;

a handrail mounted on the base over the anterior side of the seat;

straps mounted on the two sides of the support structure below the cushion configured to engage the user's legs below knees; and stirrups mounted below the straps on the two sides of the seats;

wherein the straps hold the user's legs in a position so that the user's feet are held in the straps and the user's knees are splayed out by the cushions while using the exercise apparatus.

2. An exercise apparatus as in claim 1, the handrail further comprising a T-Leg.

3. An exercise apparatus as in claim 2, further comprising a seat back mounted on the posterior end of the seat.

4. An exercise apparatus, comprising:

a base;

a support structure having at least two sides mounted on the base;

a seat supported by the support structure;

a cushion located on the least two sides of the support structure below the seat configured to splay knees of a user of the exercise apparatus;

a handrail mounted on the base over the anterior side of the seat;

straps mounted on the two sides of the support structure below the cushion and configured to engage the user's legs below the knees; and stirrups mounted below the straps on the two sides of the seat;

wherein the straps hold the user's legs in a position so that the user's feet are held in the straps and the user's knees are splayed out by the cushions while using the exercise apparatus.

5. An exercise apparatus as in claim 4, the handrail further comprising a T-Leg.

6. An exercise apparatus as in claim 4, further comprising a seat back mounted on the posterior end of the seat.

7. An exercise apparatus as in claim 4, wherein the seat is a bench type seat.

8. An exercise apparatus as in claim 4, wherein the cushion is semi-spherical.

* * * * *

UNITED STATES PATENT AND TRADEMARK OFFICE

CERTIFICATE OF CORRECTION

PATENT NO. : 7,318,795 B2
APPLICATION NO. : 11/170512
DATED : January 15, 2008
INVENTOR(S) : Ross Dauterive It is certified that error appears in the above-identified patent and that said Letters Patent is hereby corrected as shown below:

Please replace the paragraph at Col. 1, Lines 13-16, with the following paragraph:

--The present invention relates generally to exercise devices and more specifically to a method and apparatus for enabling a crippled person to exercise hips and legs to prevent hip ~~location~~ dislocation and muscle atrophy.--

Please replace the paragraph at Col. 1, Lines 17-23, with the following paragraph:

--Crippled children, particularly those with cerebral palsy typically suffer trismatic spasms which eventually dislocate the ~~greater trochanters~~ femur from the hip sockets. Remedies for this problem include major surgery every two to three years. Thus, the need exists for a system and method that enable a crippled person to exercise their hips and legs ~~that~~ to prevent hip dislocation and muscle atrophy.--

Signed and Sealed this

Twenty-fourth Day of June, 2008

JON W. DUDAS
*Director of the United States Patent and Trademark Office*